United States Patent [19]

Tell

[11] 4,395,202

[45] Jul. 26, 1983

[54] MULTI-EJECTOR

[75] Inventor: Peter Tell, Österskär, Sweden

[73] Assignee: AB Piab, Sweden

[21] Appl. No.: 264,941

[22] Filed: May 18, 1981

[30] Foreign Application Priority Data

May 21, 1980 [SE] Sweden ..... 8003819

[51] Int. Cl.[3] ..... F04F 5/22

[52] U.S. Cl. ..... 417/169; 417/174

[58] Field of Search ..... 417/169, 174, 163, 151

[56] References Cited

U.S. PATENT DOCUMENTS 1,122,148 12/1914 Gonzales ..... 417/169 X 3,959,864 6/1976 Tell ..... 417/174 X

FOREIGN PATENT DOCUMENTS 8002863 12/1980 Sweden ..... 417/174

*Primary Examiner*—Edward K. Look

*Attorney, Agent, or Firm*—Witherspoon & Hargest

[57] ABSTRACT

The present invention relates briefly to an improved multi-ejector having at least one set of ejector nozzles (12, 13, 14, 15) arranged successively for evacuating of successively arranged chambers (5, 6, 7) which chambers are in communication with a vacuum collecting compartment (16) through ports (18, 19, 20) provided with valves. At least one additional set of nozzles (24, 25) evacuates a chamber (4) in direct communication with the vacuum collecting chamber (16) and the outlet therefrom is arranged in connection with the chamber (5) in which the lowest negative pressure is existing when the first mentioned set of ejector nozzles (12, 13, 14, 15) is operating.

5 Claims, 1 Drawing Figure

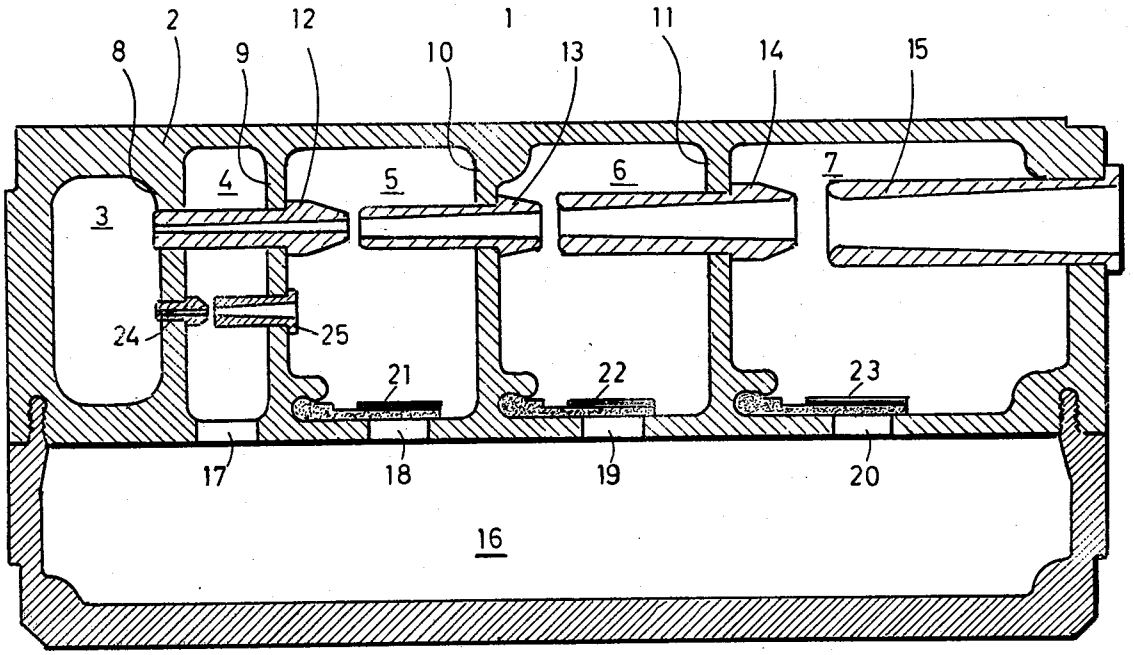
1
2
3
4
5
6
7
8
9
10
11
12
13
14
15
16
17
18
19
20
21
22
23
24
25

MULTI-EJECTOR

BACKGROUND OF THE INVENTION (1) Field of the Invention

The present invention relates to ejectors and more closely to what is called multi-ejectors in which several ejector nozzles are located successively and in some embodiments also beside each other.

(2) Description of the Prior Art

By the aid of such ejectors it has been possible when using a positive pressure of about 4 kiloponds per square centimeters to reach negative pressures corresponding to about 50% of the actual air pressure. However, it has been a desideratum to reach lower negative pressure in connection with corresponding relations.

Said desideratum has, indeed, to some extent been reached by an arrangement of ejector nozzles in the way described in Swedish patent application Ser. No. 7905309-6 and in connection therewith a negative pressure corresponding to about 7% of the actual air pressure has been obtained. However, for many fields of use also this good value is unsatisfactory, such as in connection with the manufacturing of bulbs, freeze-drying of food and similar.

In connection with manufacturing processes using negative pressures there are problems which not always are realized. To conduct negative pressures request generally more large-sized conduits than to conduct positive pressures. Conventional vacuum pumps are rather bulky and cannot be located in direct connection with the chamber or the object within which the negative pressure is desired. The result is that large-sized conduits are to be extended between pump and chamber or object.

Ejectors of the type of which the present invention refers are small light units which may be placed in direct connection with the place of use. Due to the fact that they are driven by positive pressure, i.e. compressed air, they need only narrow supply conduits therefor, simultaneously as the risks of problems due to electrical faults do not exist, something that might be present in connection with the conventional vacuum pumps. Further, the ejectors are of a simple and reliable structure, a fact that gives rise to an extra ordinary reliability in operation. Further, in comparison with conventional vacuum pumps multi-ejectors show the advantage that their capacity is very great at the same effect consumption. This means that the first part of an evacuation takes place very fast, of course depending on the fact that they do not work with any conventional stroke volume. The greater volume to be evacuated the greater economical importance this effect has as the time of evacuation is essentially shorter than with the use of conventional vacuum pumps.

SUMMARY OF THE INVENTION

By the present invention the ejectors have now got such an efficiency that they can be used where such negative pressures are required which previously were obtainable only by the aid of vacuum pumps. This has been caused by a new arrangement of the ejector nozzles and multi-ejectors designed in accordance with the present invention give rise to negative pressures corresponding to essentially less than 1% of the actual air pressure, it means one has reached pressures of an order of size of 5–10 millibars.

BRIEF DESCRIPTION OF THE DRAWINGS

The object of the invention itself and what is especially characterizing it are clear from the attached claims.

The invention is closer described in the following in connection with the attached drawing which schematically and in section shows one embodiment of a multi-ejector embodying the invention.

DESCRIPTION OF THE PREFERRED EMBODIMENT

In the shown embodiment the multi-ejector 1 comprises a housing 2 of a substantially parallel-epipedical shape and having five chambers 3–7 located in series. Ejector nozzles 12, 13, 14 are located in the walls 8–11 between the chambers as well as an ejector nozzle 15 in the outer wall. Said nozzles 12–15 are located on a common axis.

Beneath the bottom of the housing 2 there is a self-contained compartment 16 which through ports 17–20 is in communication with the chambers 4, 5, 6 and 7 respectively. The ports 18, 19 and 20 are closable by the aid of flap valves 18, 19 and 20 respectively.

To the first chamber 3 there is an inlet, not shown, for pressurized air and the last nozzle 15 in the series is acting as an outlet for the pressurized air. The first nozzle 12 extends from the first chamber 3 through the second chamber 4 and opens in the third chamber 5. Disregarding this arrangement the rest of the multi-ejector is constructed in a conventional way.

In the wall 8 between the first chamber 3 and the second chamber 4 there is an ejector nozzle 24 and in the wall 9 between the second chamber 4 and the third chamber there is an ejector nozzle 25.

The multi-ejector works in the following way:

Pressurized air is supplied into chamber 3 and the pressurized air is flowing through the nozzles 12, 13, 14 and 15. Negative pressure is then created in the chambers 5, 6 and 7 and accordingly the flap valves 21, 22 and 23 are open. When the negative pressure in the chamber 7 is substantially equal with the negative pressure in the compartment 16 the flap valve 23 closes and as the negative pressure in the compartment 16 decreases the valves 22 and 21 close.

When the negative pressure in the compartment 5 is substantially equal to the negative pressure in the chamber 16 the negative pressure has been reached which the conventional part of the ejector can create and this negative pressure is then present also in the chamber 4 as this chamber is in direct communication with the compartment 16 through the port 17.

In this condition the nozzles 24 and 25 start to work and the pressure difference between the chambers 3 and 5 is substantial due to which fact also the ejector effect is substantial. The negative pressure reached in chamber 4 and which through the port 17 is reached in compartment 16 has been shown to amount to between 1 and 0.01% of the existing atmosphere pressure, a negative pressure which it has not been possible previously to reach by the aid of ejectors.

Hence, in the shown embodiment the additional set of nozzles 24, 25 is fed from the same source of pressurized air as the rest of the nozzles. However, this set could as well be fed by supply of atmosphere air as the pressure difference over the nozzles yet is very great and sufficient to reach values of about 1% of the negative pressures. For a man skilled in the art it is also quite clear that other practical solutions of the nozzle arrangements may be used. However, the one in accordance with the described embodiment is simple and efficient.

Accordingly, by the present invention an ejector having essentially improved efficiency has been obtained.

I claim:

1. An ejector comprising a housing enclosing a plurality of chambers arranged in series and separated from a vacuum collecting compartment by a partition, said plurality of chambers comprising a first chamber, which is a pressure supply chamber, separated from a second chamber by a first wall, and at least one other chamber, said other chamber being separated from said second chamber by a second wall and having a third wall spaced from said second wall, at least one first plurality of nozzles arranged in series in a flow direction from said first chamber to said other chamber, including a first nozzle extending through said first and second walls from said first chamber to said other chamber, and a second nozzle extending through said third wall from said other chamber, at least one second plurality of nozzles arranged in series in a flow direction from said first chamber to said other chamber, said second plurality of nozzles being spaced from said first plurality of nozzles, including a first nozzle extending through said first wall from said first chamber to said second chamber, and a second nozzle extending through said second wall from said second chamber to said other chamber, a plurality of ports extending through said partition from said vacuum collecting compartment to selected of said chambers, including a first port extending from said compartment to said second chamber and a second port extending from said compartment to said other chamber, and, at least one check valve, said check valve positioned in said other chamber and associated with said second port.

2. The ejector of claim 1 wherein said plurality of chambers includes a fourth chamber separated from said other chamber by said third wall and a fifth chamber separated from said fourth chamber by a fourth wall, wherein in said first plurality of nozzles said second nozzle extends from said other chamber to said fourth chamber, said first plurality of nozzles further including a third nozzle extending through said fourth wall from said fourth chamber to said fifth chamber, and a fourth nozzle extending through said housing from said fifth chamber, and, wherein said plurality of ports further includes a third port extending from said compartment to said fourth chamber, and a fourth port extending from said compartment to said fifth chamber.

3. The ejector of claim 2 wherein said plurality of check valves further includes a second check valve positioned in said fourth chamber and associated with said third port and a third check valve positioned in said fifth chamber and associated with said fourth port.

4. The ejector of claim 1 including means for feeding pressurized air into said first chamber.

5. An ejector comprising a housing enclosing a plurality of chambers arranged in series and separated from a vacuum collecting compartment by a partition, said plurality of chambers comprising a first chamber, which is a pressure supply chamber separated from a second chamber by a first wall, a third chamber separated from said second chamber by a second wall, a fourth chamber separated from said third chamber by a third wall, and a fifth chamber separated from said fourth chamber by a fourth wall, at least one first plurality of nozzles arranged in series in a flow direction from said first chamber to said fifth chamber, including a first nozzle extending through said first and second walls from said first chamber to said third chamber, a second nozzle extending through said third wall from said third chamber to said fourth chamber, a third nozzle extending through said fourth wall from said fourth chamber to said fifth chamber, and a fourth nozzle extending through said housing from said fifth chamber, at least one second plurality of nozzles arranged in series in a flow direction from said first chamber to said third chamber, said second plurality of nozzles being spaced from said first plurality of nozzles, including a first nozzle extending through said first wall from said first chamber to said second chamber, and a second nozzle extending through said second wall from said second chamber to said third chamber, a plurality of ports extending through said partition from said vacuum collecting compartment to selected of said chambers, including a first port extending from said compartment to said second chamber, a second port extending from said compartment to said third chamber, a third port extending from said compartment to said fourth chamber, and a fourth port extending from said compartment to said fifth chamber, and, a plurality of check valves including a first check valve positioned in said third chamber and associated with said second port, a second check valve positioned in said fourth chamber and associated with said third port, and a third check valve positioned in said fifth chamber and associated with said fourth port.

* * * * *